US005943965A

United States Patent [19]

Riach et al.

[11] Patent Number: 5,943,965

[45] Date of Patent: Aug. 31, 1999

[54] COLLAPSIBLE FOLDING MASSAGE TABLE

[75] Inventors: Jeffrey M. Riach, Cockeysville, Md.; Robert E. Denoncourt, York, Pa.

[73] Assignee: Oakworks, Inc., Glen Rock, Pa.

[21] Appl. No.: 08/997,377

[22] Filed: Dec. 23, 1997

Related U.S. Application Data

[60] Provisional application No. 60/080,232, Aug. 1, 1997.

[51] Int. Cl.[6] ..... A47B 3/00

[52] U.S. Cl. ..... 108/36; 108/131

[58] Field of Search ..... 108/36, 38, 132, 108/160

[56] References Cited

U.S. PATENT DOCUMENTS

| | | | |
|---|---|---|---|
| 14,877 | 5/1856 | Lyford . | |
| 3,237,575 | 3/1966 | Larson | 108/160 |
| 4,191,111 | 3/1980 | Emmert | 108/132 |
| 4,643,103 | 2/1987 | Jorgensen | 108/132 |
| 4,833,998 | 5/1989 | Everett et al. . | |
| 5,009,170 | 4/1991 | Spehar . | |

*Primary Examiner*—Peter M. Cuomo
*Assistant Examiner*—Gerald A. Anderson
*Attorney, Agent, or Firm*—Sixbey, Friedman, Leedom & Ferguson, P.C.; Charles M. Leedom, Jr.; Daniel S. Song

[57] ABSTRACT

An improved collapsible folding massage table with four folding leg assemblies having improved folding and stabilizing features which eliminates a second cross brace wherein the leg assemblies include a folding leg brace and an elongated strut with a slot that slidingly receives a pivot pin on the folding leg brace. The table also includes a pair of cables interconnecting pivot pins of the leg braces on the opposing side of the table thereby facilitating unfolding of the table while preventing the table legs from folding when the table is in use. The collapsible foldable table also includes stabilized leg blocks to which the elongated struts are pivotally attached and horizontally offset from the pivot pin of the corresponding table leg also attached to the leg block. Furthermore, the collapsible foldable table also includes integral hinges that hingedly attaches two table top sections and also include provisions for attaching members of the folding leg braces.

24 Claims, 5 Drawing Sheets

COLLAPSIBLE FOLDING MASSAGE TABLE

This application claims the benefit of Provisional Application Ser. No. 60/080,232, filed Aug. 1, 1997.

BACKGROUND OF THE INVENTION

1. Field of the Invention

The present invention is related to the field of collapsible, folding tables. More specifically, the invention relates to collapsible, folding massage tables wherein folding and opening of the table is made easier by providing folding leg assemblies with improved folding and stabilizing features.

2. Description of Related Art

Collapsible tables with foldable leg braces are generally known in the art. These collapsible folding tables have some distinct advantages over conventional tables because they can be transported to various locations more easily and can be stored in small spaces. Such portability and small size is very important to various professional trades such as massage services where massage practitioners who visit numerous clients at various locations need specialized massage tables to provide their services. The collapsible folding massage table is often transported in the massage practitioner's vehicle from one location to another and carried and set up by the massage practitioner at the client's location. Therefore, such collapsible folding massage table must be portable, small, light weight and easy to set up and collapse.

One of the disadvantages of such collapsible folding table is that it is not as strong or structurally stable as a conventional table. The joints and hinges used to allow the table to be collapsible and fordable also decrease the structural rigidity of the table and diminish the table's strength and stability. This weakness and instability is especially problematic for a massage table because clients lay on the table surface when the massage practitioner provides his or her services, thus, if the table collapses or if the client falls off the table because the table is unstable, the client is likely to be injured. Consequently, the collapsible table must also have high strength, rigidity and stability so that it will not collapse during use.

A mechanism to automatically set up legs of a foldable chair is shown in patent document No. 180 relating to the original U.S. Pat. No. 14,877 to Lyford which discloses a folding chair including two frame sections hinged together, legs which are attached to the frames by screw pins and jointed braces that support the legs. The reference also discloses a strap which operates to set up the table legs and securely hold the brace joints when the two frame sections are opened.

An example of a collapsible massage table using a similar set up mechanism disclosed in Lyford is shown in U.S. Pat. No. 4,833,998 to Everett et al. that discloses a collapsible massage table with two table top sections that are hingedly connected and two pairs of legs hingedly connected to the table top sections. Each leg is supported by a foldable leg brace and a horizontal cable interconnecting the leg braces (FIG. 2A). The reference also discloses that each brace is formed of two brace members and includes a brace stop to prevent the brace members from folding down beyond the coaxial (open) position into a folded (side by side) position. While operable for the purposes disclosed, collapsible tables designed in accordance to the Everett reference lack rigid support of the leg braces, especially at the hinged connection where the two brace members are hingedly connected to one another. Consequently, this lack of rigid support of the leg braces contributed to the lack of structural rigidity of the table and increased the table's lateral instability.

U.S. Pat. No. 5,009,170 to Spehar, which also uses the set up mechanism disclosed in the Lyford Reissue, attempts to overcome the instability of Everett's table design by adding an additional cross brace at each end of the table attached to one portion of each of the two foldable support arms (leg braces) to impart lateral strength to the table and limit the movement of each foldable support arm at its fully unfolded position. Additional cross braces have the effect of increasing weight and cost while diminishing portability of the massage table. Spehar's design attempts to further increase stability by providing a rigidifying cable connection between the center pivot area of each foldable support arm and the area at which the corresponding leg is pivotally mounted to the foldable table. Because flexible cables are inherently stretchable to some limited degree, foldable tables built in accordance with the Spehar '170 are inherently subject to being unstable under high loads.

FIGS. 1–3 illustrate prior art massage table designs. In particular, FIG. 1 illustrates a massage table 1 including a pair of hingedly-connected table top sections 2 and 2' and two leg assemblies 6 and 6' which are hingedly connected to the outer peripheral portions of the respective table top sections 2 and 2'. Each leg assembly includes a pair of legs 7 and 7' supported by foldable leg braces 15 and a second cross brace 11 which rigidly connect each leg pair to improve lateral strength to the table and limit the movement of the folding leg brace at its fully unfolded position. However, as previously noted, these additional second cross braces increase weight and cost of the massage table and diminishes the table's portability.

Each foldable leg brace is interconnected to the foldable leg brace of the opposing leg on the opposing table top section by a horizontal cable 10 and is also connected to a table top section by a secondary cable 16 which aids in resisting downward movement of the center of the table. However, because these secondary cables stretch slightly under load, the center of the table exhibit excessive downward movement when the table is heavily loaded. Furthermore, the secondary cables often become tangled when the table is set up or collapsed and often protrude from the folded table allowing it to snag on something when being carried. Thus, this improved prior art table design does not provide an optimally designed table which is also rigid and stable under heavy loads and does not provided a table which can be easily folded.

FIGS. 2 and 3 more clearly show a prior art massage table including a hinge 14 which attaches the table top sections 2 and 2' together. FIGS. 1–3 further show folding leg braces 8 attached to the underside of the respective table top sections 2 and 2' at a brace attachment 13. FIG. 3 clearly shows second cross braces 11 that rigidly connect each pair of leg braces. These separate components including hinge 14, brace attachment 13 and the second cross braces 11, all of which add weight to the massage table thereby diminishing the table's portability, further increases the material and manufacturing costs of the massage table.

Therefore, there is a substantial and unfulfilled need for an improved collapsible folding massage table which is rigid and stable, even under heavy loads and is easy to set up and collapse and also light and less costly to manufacture.

SUMMARY OF THE INVENTION

In view of the foregoing, it is an object of the present invention to provide an improved collapsible foldable table with foldable leg brace that is highly portable, light weight and is easy to set up and collapse.

A second object of the present invention is to provide an improved collapsible foldable table that is structurally rigid and stable, even under heavy loads, without a second cross brace or secondary cables.

A third object of the present invention is to provide an improved collapsible foldable table wherein the stability of the table is improved and the cost and weight of the table is reduced by an integral hinge which is designed to attach the two table top sections and also attach a pair of leg brace members to the underside of the respective table top sections.

Another object of the present invention is to provide an improved collapsible foldable table including a hingedly mounted elongated strut which contains a slot for slidingly receiving a pivot bolt which joins the members of a foldable leg brace thereby eliminating the need for second cross braces that connect opposing pairs of foldable leg braces and also eliminates foldable leg brace stops and secondary cables.

Yet another object of the present invention is to provide an improved collapsible foldable table including stabilized leg block with provisions to hingedly attach a folding table leg and an elongated strut.

In accordance with preferred embodiments of the present invention, these and other objects are obtained by an improved collapsible foldable table including two table top sections hingedly attached by integral hinges with provisions for attaching a leg brace member, and four folding leg assemblies, each assembly having a folding leg pivotally mounted to the massage table top sections by a stabilized leg block to which is also hingedly mounted an elongated strut containing a slot for slidingly engaging a pivot bolt joining the leg brace members.

These and other objects, features and advantages of the present invention will become more apparent from the following detailed description of the preferred embodiments of the invention when viewed in conjunction with the accompanying drawings.

DETAILED DESCRIPTION OF THE PREFERRED EMBODIMENTS

Figure 1:
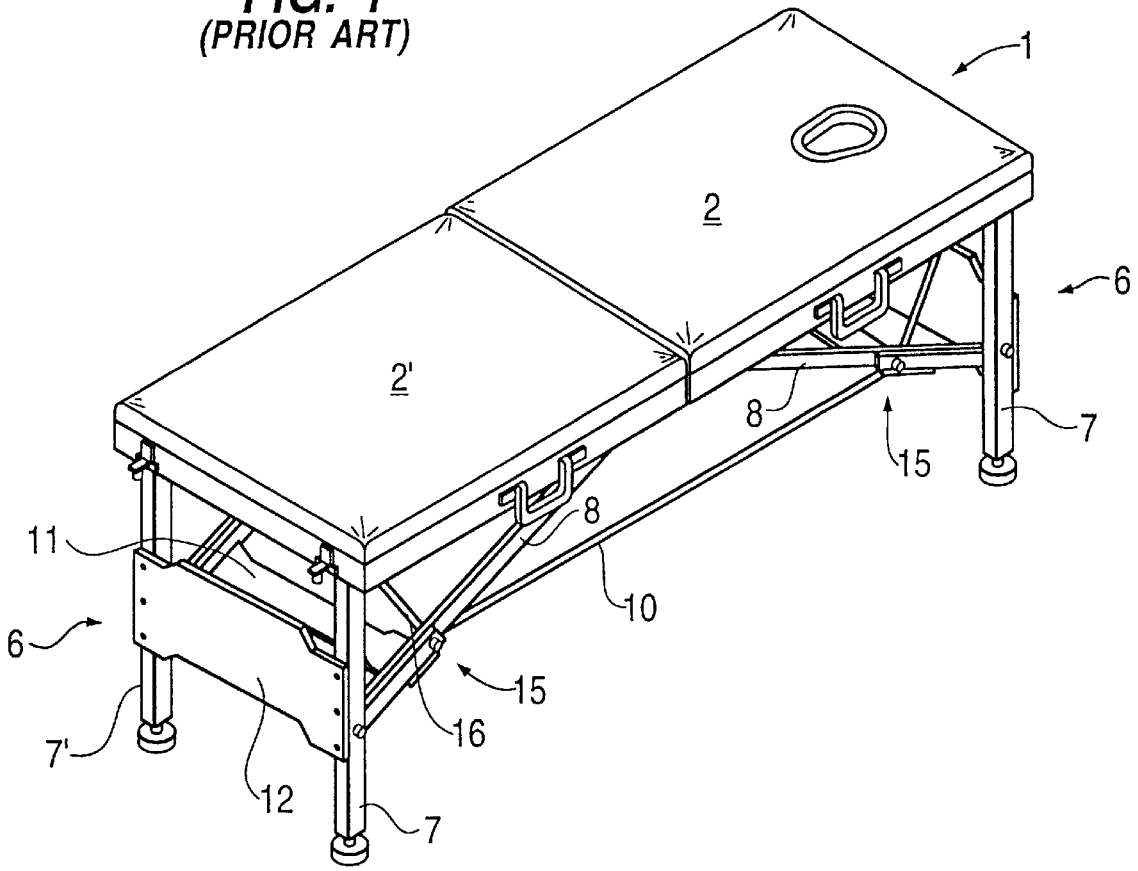
FIG. 1 (PRIOR ART)
FIG. 1 is a perspective view of a massage table in accordance to the prior art disclosing the general features and components of the prior art table.
Figure 2:
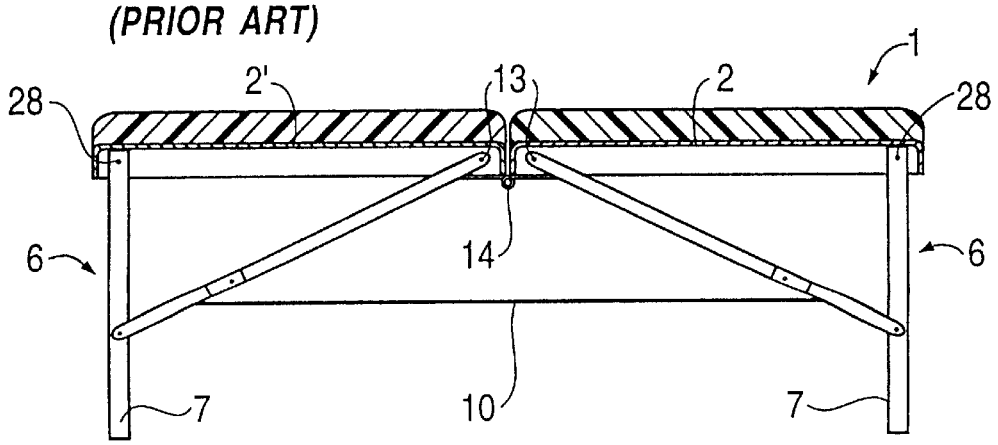
FIG. 2 (PRIOR ART)
FIG. 2 is a cross-sectional view of another massage table in accordance to the prior art.
Figure 3:
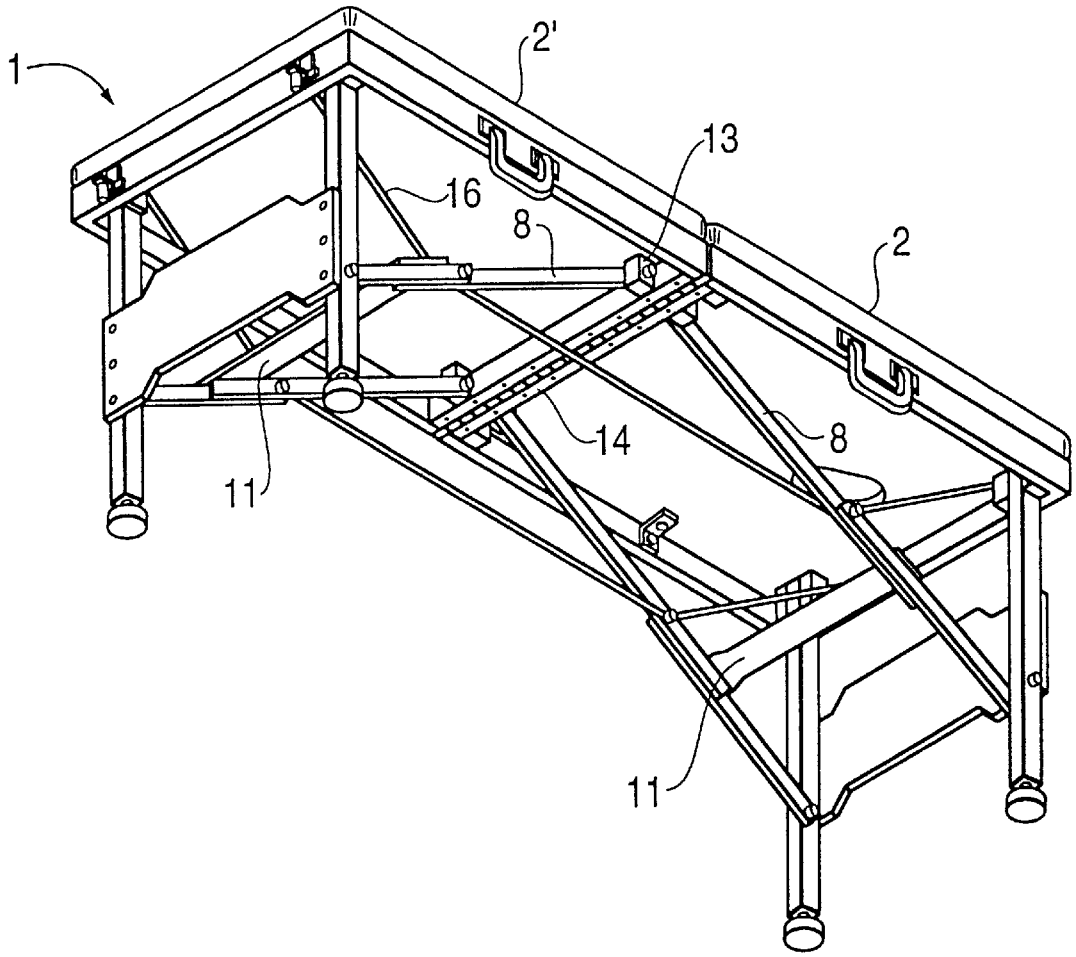
FIG. 3 (PRIOR ART)
FIG. 3 is a view of the underside of a massage table shown in FIG. 1.
Figure 4:
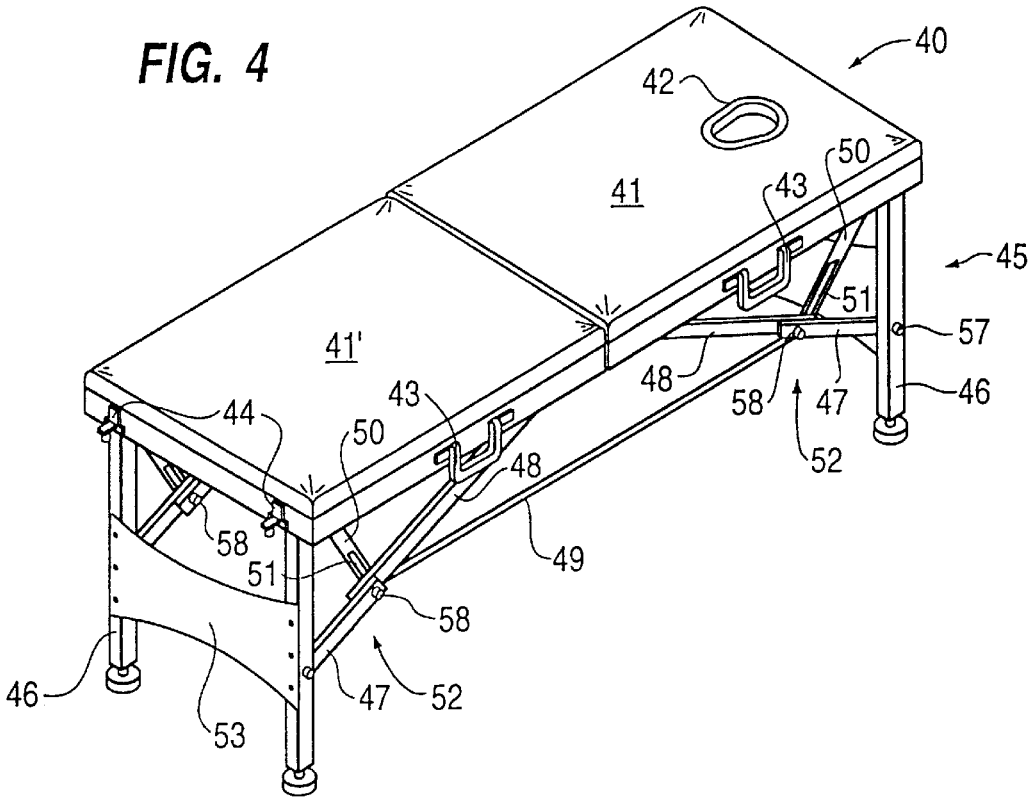
FIG. 4 is a perspective view of a massage table in accordance to the preferred embodiment of the present invention disclosing the general features and components of the table.

FIG. 4 illustrates a massage table 40 in accordance to the preferred embodiment of the present invention that includes a pair of hingedly-connected table top sections 41 and 41', illustrated in their operative co-planar position, and four substantially identical legs 46 pivotally connected adjacent each of the four outer corners of the table top sections 41 and 41' which are illustrated in their operative position. The massage table 40 is further provided with an automatic set up and rigidifying mechanism SRM for outswinging all four legs 46 into operative positions as the table top sections are unfolded into their the co-planar position illustrated in FIG. 4. In addition to simplifying set up, the automatic set up and rigidifying mechanism SRM further automatically actuates a unique undergirding system of braces, struts, mounting blocks, hinge assemblies and cables to maintain the table top sections 41 and 41' in their co-planar operative position, even when subjected to loading and forces that would cause sagging or even failure in more conventional folding table designs. Each leg 46 is associated with a corresponding mounting block, brace and strut of the automatic set up and rigidifying mechanism SRM to form a leg assembly 45. Although the following discusses only one leg assembly in detail, the discussion is equally applicable to the other leg assemblies as well.

Each leg assembly includes a leg 46 rotatable attached to one of the outer corners of a table top section by a leg block (discussed in greater detail below) located at each of the four outer ends of the table top sections. Each leg assembly is further provided with a leg brace 52 comprising an upper brace member 48 and a lower brace member 47. The upper brace member 48 is pivotally attached at one end, to the underside of a table top section and pivotally attached to one end of the lower brace member 47 by a pivot bolt 58. While pivot bolts are used as pivotal attachment means here and in other pivot attachments, different attachment means may be used including pins, rivets and fasteners known in the art. The other end of the lower brace member 47 is pivotally attached to a leg by a pivot bolt 57.

The leg assemblies 45 also include an elongated strut 50, each strut containing a slot 51 for slidingly engaging the pivot bolt 58 or, as will be discussed in greater detail below, a sliding connection mounted adjacent the pivot bolt 58. The elongated strut 50 is pivotally attached to the leg block (discussed further below) and replaces the flexible cable extensions used in the prior art. The elongated strut 50 which is relatively rigid, imparts substantially increased structural rigidity and stability to the leg brace 52 as compared with the use of a flexible cable. A rigid strut is thus able to increase the structural rigidity and stability of the table 40 sufficiently to eliminate the need for a second cross brace 11 as used at each end of certain table designs known in the prior art. By eliminating the cross brace, the weight and material cost of the table can be reduced. The unique elongated strut 50 also acts to retain the leg brace 52 at its fully unfolded, operative position thereby eliminating the need for a brace stop also used in tables of the prior art. By eliminating the secondary cables of the prior art, the elongated strut 50 also eliminates the possibility of tangling and snagging problems associated with them. In addition, the elongated strut 50 facilitates folding of the table by directing the motion of the leg brace 52.

Because the rigid elongated strut 50 can be manufactured with tighter geometric tolerances, the resulting assembled table is more stable and structurally more rigid. In the present invention, the length of the elongated struts 50 are manufactured to +/−0.005 inch tolerances in comparison to prior art secondary cables which are manufactured to +/−0.035 inch tolerances. Furthermore, because the rigid elongated strut 50 can be formed to be substantially more resistant to stretching as compared with flexible cables, the elongated strut 50 further prevents excessive downward movement of the center of the table under heavy loads. Although the elongated strut 50 is made from steel in the preferred embodiment, the strut can also be made from other materials such as aluminum alloy, plastics, etc.

A massage table in accordance with the preferred embodiment of the present invention also includes a horizontal cable 49 interconnecting each leg brace 52 to the leg brace of the opposing leg assembly on the opposing table top section. These cables facilitate the set up of the table by causing the legs to unfold automatically when the hingedly connected table top sections 41 and 41' are unfolded to a co-planar position. These cables further prevent any upward folding of each brace 52 when the table top sections are unfolded to a co-planar position thereby preventing the table legs from collapsing when the table is being used. Each leg pair associated with each table top section is also rigidly connected by an end plate 53 that further give structural rigidity and lateral support to the table.

A face hole 42, a pair of carrying handles 43 and a pair of closing latches 44 may also be provided on the massage table.

Figure 5:
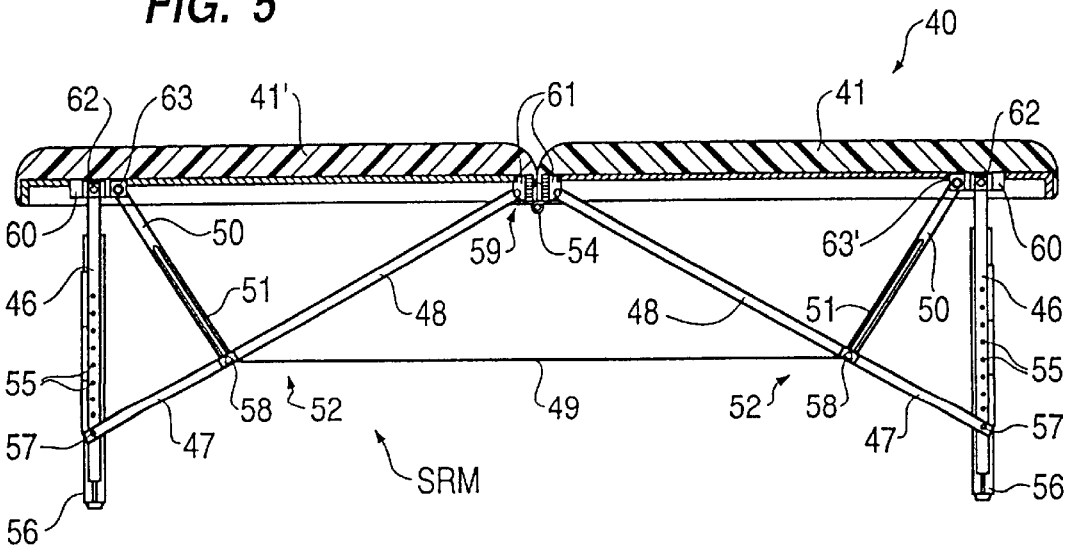
FIG. 5 is a cross-sectional view of a massage table in accordance to the preferred embodiment of the present invention.
Figure 6:
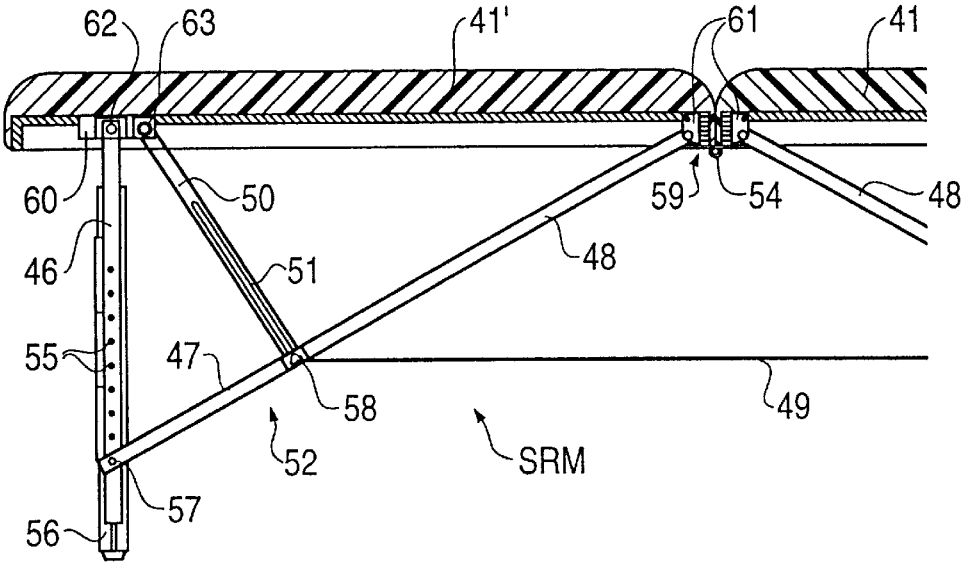
FIG. 6 is an enlarged view of the cross-sectional view of the massage table in FIG. 5.

As can be seen, FIG. 5 and FIG. 6 show a cross sectional view of a massage table 40 in accordance with the preferred embodiment of the present invention including the elongated strut 50 containing slot 51 and leg 46 pivotally mounted to a leg block 60 by pivot bolt 62. The FIGS. 5 and 6 also clearly show an integral hinge 54 which hingedly mounts the two table top sections 41 and 41' and the upper brace member 48 hingedly attached to an integral hinge 59. Furthermore, the FIGS. 5 and 6. show an alternate embodiment of the leg 46 including a height adjustable leg member 56 that can be used to raise the standing height of the massage table by aligning the alignment holes 55 and inserting a retaining pin (not shown) into the alignment holes.

Figure 7:
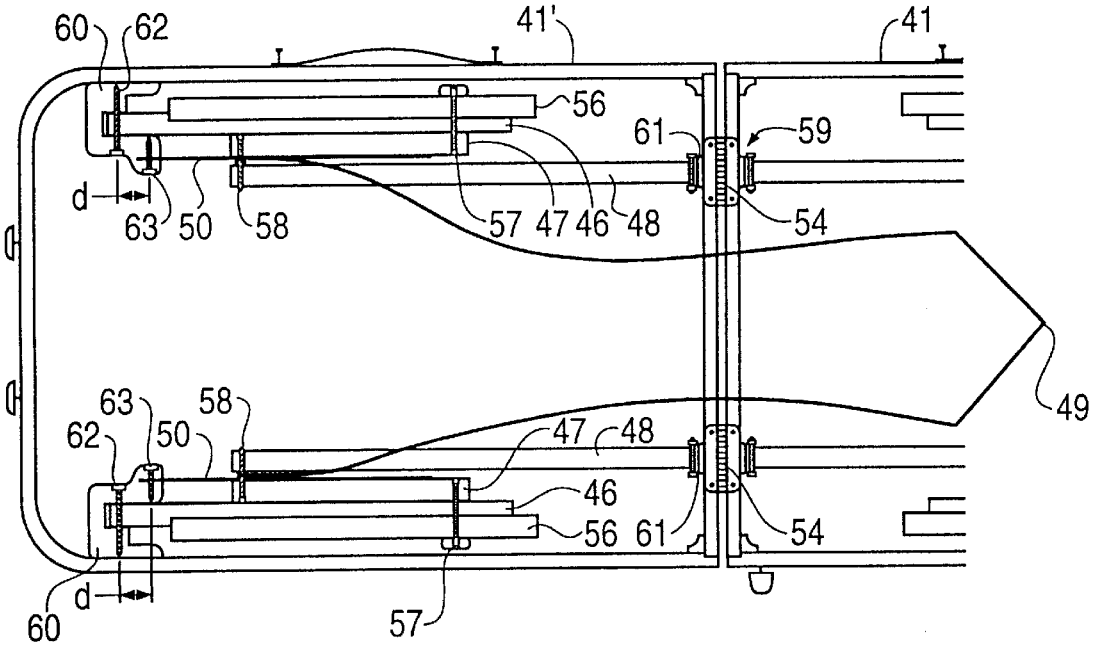
FIG. 7 is a enlarged view of the underside surface of one of the table top sections of a massage table in accordance to the preferred embodiment of the present invention wherein the table top sections are in a partially folded position.

An enlarged view of the underside surface of one of the table top sections of a massage table in accordance to the preferred embodiment of the present invention is shown in FIG. 7 which clearly shows leg blocks 60 to which a leg 46 is pivotally attached by a pivot bolt 62 and to which the elongated strut 50 is also pivotally attached by a pivot bolt 63. Both the leg 46 and the elongated strut 50 are supported by the leg block 60 on both sides to increase the load capacity and stiffness of the attachments while minimizing lateral movements of the leg and the elongated strut. In addition, both pivot bolts 62 and 63 are supported at both ends by the leg block 60 to further increase the load capacity and stiffness of the table. Furthermore, in the preferred embodiment, the pivot point for the elongated strut 50 is offset horizontally by distance d from the pivot point of the corresponding table leg 46. Although the elongated strut 50 can be attached to the pivot bolt 62 of the table leg 46, the distance d which offsets the pivot point of the elongated strut and the leg, makes the leg assembly 45 more rigid and the table 40 more stable and at the same time, reduces the force required to set up and fold the table leg assemblies. In addition, the offset and use of two pivot bolts allows the alignment of the pivot points to eliminate unnecessary torsion or bending of the table leg 46, the elongated strut 50, or the leg brace 52 which can diminish the lateral stability of the table. The use of two pivot bolts also reduces the shear stresses carried by the bolts in comparison to a less preferred embodiment wherein both the leg and the elongated strut is attached by the same pivot bolt at the same pivot point. Although the leg block 60 in the preferred embodiment is made from plastic or nylon, it may also be made from other materials including different types of wood, composites, alloys and even sheet metal with properly located pivot points.

FIG. 7 also shows the integral hinge 59 in accordance with the preferred embodiment of the present invention including a hinge 54 for hingedly attaching the two table top sections 41 and 41' and an integral attaching means 61 for pivotally attaching ends of the upper brace members 48. This integral hinge 59 combines the functions of a conventional hinge 14 (prior art) with brace attachment 13 (prior art) of the prior art tables into a single, lighter, stronger and more compact component. The integral hinge 59 in accordance with the preferred embodiment of the present invention is more clearly shown in FIGS. 8–10 and is comprised of brackets 65 and 65' which are made of a strong material such as steel and are hingedly joined by a hinge pin 54. Each bracket is fixedly attached to the respective table top sections 41 and 41' by a fastener (not shown) fastened through hinge fastening holes 71 thereby allowing the table top sections to be moved between a working configuration, wherein the two table top sections are co-planar and a folded configuration wherein the table top sections are substantially parallel. Although four hinge fastening holes 71 are shown for the integral hinge 59 in FIG. 8, a different number of hinge fastening holes may be provided to ensure secure fastening of the brackets 65 and 65'.

Figure 8:
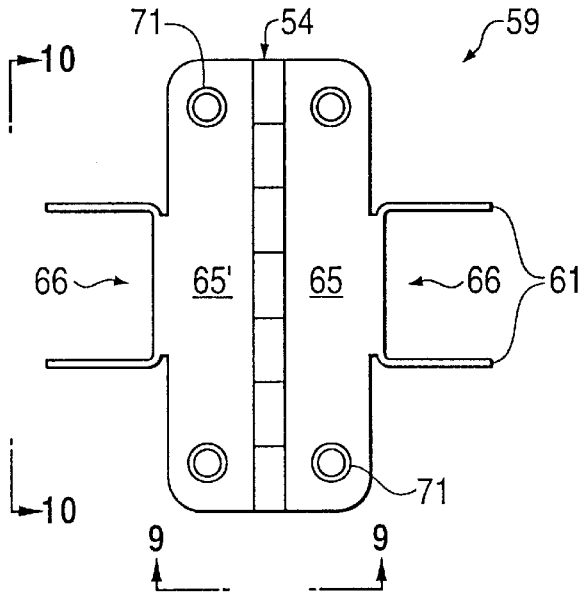
FIG. 8 is a perspective view of the integral hinge in accordance to the preferred embodiment of the present invention.
Figure 9:
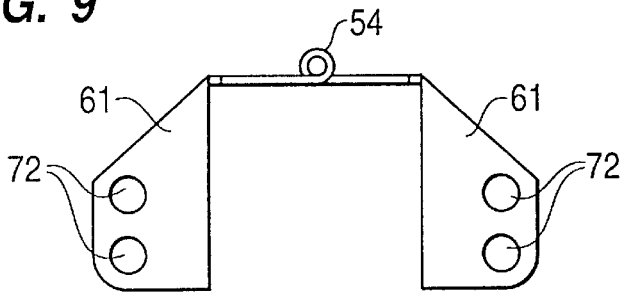
FIG. 9 is a side view of the integral hinge shown in FIG. 8 as viewed from a plane indicated as A—A.
Figure 10:
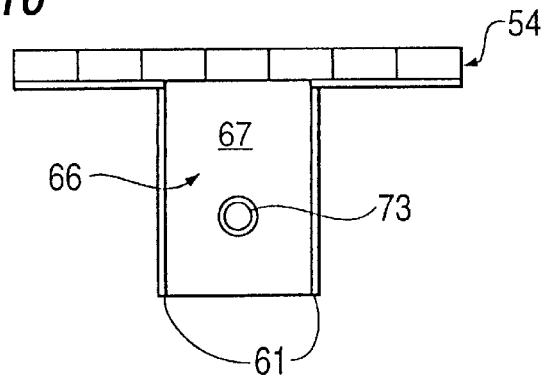
FIG. 10 is a side view of the integral hinge shown in FIG. 8 as viewed from a plane indicated as B—B.

As can be clearly seen in FIGS. 8–10, each bracket 65 and 65' includes an integral attaching means for attaching upper brace member 48. The integral attaching means includes extending flanges 61 which form a upper brace member receiving area 66. The extending flanges 61 include attachment holes 72 for pivotally attaching an end of the upper brace member 48 using pivot bolt or other fastening means. Although four attachment holes 72 are shown for the integral hinge 59 in FIG. 9, a different number of attachment holes may be provided for pivotally attaching upper brace member 48. Each bracket 65 of the integral hinge 59 also includes an end wall 67 in the upper brace member receiving area 66 from which the extending flanges 61 are integrally formed. The end wall 67 wraps around a frame member of the table top section and may include a secondary hinge fastening hole or holes 73 which allows the brackets 65 and 65' to be fastened onto the table top sections 41 and 41' at a plane perpendicular to the fastening plane of the hinge fastening holes 71 thereby providing even more secure attachment of the brackets 65 and 65'. In addition, because the leg brace 52 is directly connected to the integral hinge 59 by the extending flanges 61 and pivot bolts (not shown), the leg brace 52 gives direct support to forces exerted on the integral hinge 59. Thus, when there is a downward force exerted on the hinge which causes downward movement on the hinge pin 54, the leg brace 52 becomes compressed and exerts a counter force with an upward component, directly on the integral hinge 59 thereby reducing the shear stresses on the fasteners which fasten the hinge through the hinge fastening holes 71. Therefore, the integral hinge 59 increases the strength of the attachment of the two table top sections 41 and 41' and increases the structural stability and rigidity of the present massage table.

From the foregoing, it should now be apparent how the present invention provides an improved collapsible foldable massage table which is highly portable, light weight and easy to set up and collapse and is also structurally rigid and stable even under heavy loads. It should now also be apparent how the present invention provides an collapsible foldable massage table which eliminates second cross braces, secondary cables, leg brace stops and separate brace attachments thereby reducing the material cost and weight of the table. In addition, it should also be apparent how the present invention provides a novel integral hinge, an elongated strut with a slot and a stabilized leg block which act to improve the structural rigidity, lateral stability and strength of the table.

We claim:

1. A collapsible, foldable table comprising:

at least two table top sections, at least one hinge connecting said table top sections to allow said table top sections to be moved between a working configuration, wherein said table top sections are co-planar and a collapsed configuration wherein said table top sections are folded into a substantially parallel orientation;

a plurality of table legs rotatably attached to said table top sections; and set up and rigidifying means for outswinging said legs into an extended position as said table top sections are unfolded into said co-planar position and automatically creating an undergirding system to maintain said table top sections in said co-planar position even when subjected to substantial forces, said set up and rigidifying means including a bracing means for supporting said table legs in said extended position when said bracing means are moved to an operative position; said bracing means including a plurality of brace members corresponding in number to at least the number of said table legs, each said brace member being pivotably attached to one of said at least two table top sections; and a brace retaining means for retaining said bracing means in said operative position, said brace retaining means including a slotted rigid strut in continuous sliding engagement with said bracing means as said table top sections are moved between said working configuration and said collapsed configuration.

2. A collapsible, foldable table of claim 1, wherein said bracing means for supporting said table legs includes a pivoting means for pivotally attaching said plurality of brace members to one another, and said pivoting means slidingly engaging said slotted rigid strut.

3. A collapsible, foldable table of claim 1, wherein said bracing means for supporting said table legs includes a pivoting means for pivotally attaching said plurality of brace members to one another, a locator means on at least one of said plurality of brace members for properly locating said bracing means; and said locator means slidingly engaging said slotted rigid strut.

4. A collapsible, foldable table of claim 1, including leg block attached to said table top section;

wherein said leg block includes an attachment means for pivotally attaching said table leg and an attachment means for pivotally attaching said brace retaining means.

5. A collapsible, foldable table of claim 4, wherein said attachment means for pivotally attaching said table leg is offset horizontally by a predetermined distance from said attachment means for pivotally attaching said brace retaining means.

6. A collapsible, foldable table of claim 1, wherein said at least one hinge connecting said table top sections includes an integral attaching means for pivotally attaching said bracing means.

7. A collapsible, foldable table of claim 1, wherein said at least one hinge connecting said table top sections includes a plurality of bracketing means for attachment to said table top sections, hingedly joined by a hinging means to allow said table top sections to be pivoted relative to one another; and a receiving means integrally formed from said bracketing means for receiving and pivotally attaching an end of said bracing means.

8. A collapsible, folding table of claim 1, including a pair of cables interconnecting said bracing means on one top section to said bracing means on an opposing said table top section.

9. A collapsible folding table of claim 1, wherein said leg includes a length adjustable means for adjusting the height of said table.

10. A collapsible, foldable table comprising:

at least two table top sections, at least one hinge connecting said table top sections to allow said table top sections to be moved between a working configuration, wherein said table top sections are co-planar and a collapsed configuration wherein said table top sections are folded into a substantially parallel orientation;

a plurality of table legs rotatably attached to said table top sections; and set up and rigidifying means for outswinging said legs into an extended position as said table top sections are unfolded into said co-planar position and automatically creating an undergirding system to maintain said table top sections in said co-planar position even when subjected to substantial forces, said set up and rigidifying means including a bracing means for supporting said table legs in said extended position when said bracing means are moved to an operative position; and a brace retaining means for retaining said bracing means in said operative position, said brace retaining means including a rigid strut; and wherein said at least one hinge connecting said table top sections includes an integral attaching means for pivotally attaching said bracing means.

11. A collapsible, foldable table comprising:

at least two table top sections, at least one hinge connecting said table top sections to allow said table top sections to be moved between a working configuration, wherein said table top sections are co-planar and a collapsed configuration wherein said table top sections are folded into a substantially parallel orientation;

a plurality of table legs rotatably attached to said table top sections; and set up and rigidifying means for outswinging said legs into an extended position as said table top sections are unfolded into said co-planar position and automatically creating an undergirding system to maintain said table top sections in said co-planar position even when subjected to substantial forces, said set up and rigidifying means including a bracing means for supporting said table legs in said extended position when said bracing means are moved to an operative position; and a brace retaining means for retaining said bracing means in said operative position, said brace retaining means including a rigid strut; and wherein said at least one hinge connecting said table top sections comprises:

a plurality of bracketing means for attachment to said table top sections, hingedly joined by a hinging means to allow said table top sections to be pivoted relative to one another; and, a receiving means integrally formed from said bracketing means for receiving and pivotally attaching an end of said bracing means.

12. A collapsible, foldable table comprising:

a pair of rectangular table top sections;

at least one hinge member connecting said table top sections to allow said table top sections to be moved between a working configuration, wherein said table top sections are co-planar and a folded configuration wherein said table top sections are substantially parallel; and a plurality of table legs rotatably attached to said table top sections, each of said leg including a leg brace, and an elongated strut;

wherein said leg brace includes a lower brace member and an upper brace member;

wherein said lower brace member is pivotally attached at one end to said table leg by a pivotal attachment and is pivotally attached at another end to said upper brace member by a pivotal attachment;

wherein said upper brace member is pivotally attached at one end to said table top section by a pivotal attachment and is pivotally attached at another end to said lower brace member by said pivotal attachment; and, wherein said elongated strut is pivotally attached at one end to said table top section by a pivotal attachment and includes a slot for slidingly engaging said pivotal attachment attaching said lower brace member and said upper brace member.

13. A collapsible, foldable table of claim 12, wherein said slot on said elongated strut retains said leg brace in an operative position.

14. A collapsible, foldable table of claim 12, including leg block attached to said table top section;

wherein said leg block includes pivotal attachments for pivotally attaching said table leg and pivotal attachments for pivotally attaching said elongated strut.

15. A collapsible, foldable table of claim 14, wherein each of said leg blocks include said pivotal attachment for pivotally attaching said table leg which is offset horizontally by a predetermined distance from said pivotal attachment for pivotally attaching said elongated strut.

16. A collapsible, foldable table of claim 14, wherein said pivotal attachments for pivotally attaching said table leg and pivotal attachments for pivotally attaching said elongated strut are each comprised of a pivot pin with two ends, said pivot pin being supported on both ends by said leg block.

17. A collapsible, foldable table of claim 12, wherein said at least one hinge member connecting said table top sections comprises:

a plurality of brackets hingedly joined by a hinge pin; and, a plurality of flanges integrally formed and extending from said brackets for receiving and pivotally attaching an end of said upper brace member.

18. A collapsible, foldable table of claim 12, including a pair of cables interconnecting said leg brace on one top section to said leg brace of an opposing leg assembly on an opposing said top section.

19. A collapsible, foldable table of claim 12, wherein said leg includes a length adjustable means for adjusting the height of said table.

20. A collapsible, foldable table of claim 12, wherein said at least one hinge member connecting said table top sections include integral attaching means for pivotally attaching an end of said upper brace member.

21. A foldable table comprising:

at least two table top sections;

at least one hinge member connecting said table top sections to allow sections to be moved between a working configuration, wherein said table top sections are co-planar and a folded configuration wherein said table top sections are substantially parallel; and a plurality of table legs;

wherein at least one table leg of said plurality of table legs is supported by a leg brace;

wherein said at least one hinge member connecting said table top section includes integral attaching means for pivotally attaching an end of said leg brace; and wherein said at least one hinge member connecting said table top sections includes at least two brackets hingedly joined by a hinge pin and a plurality of flanges integrally formed and extending from said at least two brackets for receiving and pivotally attaching an end of said leg brace.

22. A table comprising:

a table top portion; and a plurality of table legs attached to said table top portion;

wherein at least one table leg is collapsible and includes a leg brace, and an elongated strut;

wherein said leg brace includes at least two brace members pivotally attached by a pivotal attachment to one another; and wherein said elongated strut is pivotally attached at one end to said table top portion by a pivotal attachment and includes a slot for slidingly engaging said pivotal attachment attaching said at least two brace members;

including a leg block attached to said table top portion;

wherein said leg block includes pivotal attachments for pivotally attaching both said collapsible table leg and pivotal attachments for pivotally attaching said elongated strut; and wherein each of said leg blocks include said pivotal attachment for pivotally attaching said collapsible table leg which is offset horizontally by a predetermined distance from said pivotal attachment for pivotally attaching said elongated strut.

23. A table of claim 22, wherein said pivotal attachments for pivotally attaching said table leg and pivotal attachments for pivotally attaching said elongated strut are each comprised of a pivot pin with two ends, said pivot pin being supported on both ends by said leg block.

24. A collapsible, foldable table comprising:

at least two table top sections, at least one hinge connecting said table top sections to allow said table top sections to be moved between a working configuration, wherein said table top sections are co-planar and a collapsed configuration wherein said table top sections are folded into a substantially parallel orientation;

a plurality of table legs rotatable attached to said table top sections; and set up and rigidifying means for outswinging said legs into an extended position as said table top sections are unfolded into said co-planar position and automatically creating an undergirding system to maintain said table top sections in said co-planar position even when subjected to substantial forces, said set up and rigidifying means including a bracing means for supporting said table legs in said extended position when said bracing means are moved to an operative position; and a brace retaining means for retaining said bracing means in said operative position, said brace retaining means including a rigid strut; and a leg block attached to said table top section;

wherein said leg block includes an attachment means for pivotally attaching said table leg and an attachment means for pivotally attaching said brace retaining means; and said attachment means for pivotally attaching said table leg is offset horizontally by a predetermined distance from said attachment means for pivotally attaching said brace retaining means.

* * * * *